US007347657B2

(12) United States Patent
Brunn

(10) Patent No.: US 7,347,657 B2
(45) Date of Patent: Mar. 25, 2008

(54) SIMPLIFIED REFUSE COLLECTION APPARATUS

(76) Inventor: Larry Brunn, 2323 S. Butte Ave., Tempe, AZ (US) 85282

( * ) Notice: Subject to any disclaimer, the term of this patent is extended or adjusted under 35 U.S.C. 154(b) by 216 days.

(21) Appl. No.: 10/980,358

(22) Filed: Nov. 3, 2004

(65) Prior Publication Data

US 2006/0104764 A1 May 18, 2006

(51) Int. Cl.
*B65F 3/04* (2006.01)

(52) U.S. Cl. ..... 414/408; 414/409; 414/420; 294/106

(58) Field of Classification Search ..... 414/405, 414/408–409, 420, 505, 541, 549, 555, 739; 294/116, 110.2
See application file for complete search history.

(56) References Cited

U.S. PATENT DOCUMENTS 4,543,028 A * 9/1985 Bell et al. ..... 414/408
5,020,844 A * 6/1991 Pickrell ..... 294/86.4
5,026,104 A * 6/1991 Pickrell ..... 294/86.4
5,419,671 A * 5/1995 Smith et al. ..... 414/421
5,547,332 A * 8/1996 Smith et al. ..... 414/810
5,846,044 A * 12/1998 Smith et al. ..... 414/408
6,095,744 A * 8/2000 Harrison ..... 414/408
6,821,074 B2 * 11/2004 Schreiber et al. ..... 414/408
7,037,061 B2 * 5/2006 Hund et al. ..... 414/408

FOREIGN PATENT DOCUMENTS

EP 247705 A2 * 12/1987

* cited by examiner

*Primary Examiner*—Saul Rodriguez
*Assistant Examiner*—Charles Greenhut
(74) *Attorney, Agent, or Firm*—Parsons & Goltry; Robert A. Parsons; Michael W. Goltry

(57) ABSTRACT

Refuse collection apparatus including a collection container grasping mechanism and a lifting and dumping mechanism. The grasping mechanism includes a pair of grasping arms mounted for movement between an at-rest position and a grasping position, springs attached to the grasping arms so as to bias the grasping arms into the at-rest position, and a first hydraulic cylinder attached to an activating element for moving the grasping arms from the at-rest position into the grasping position. The lifting and dumping mechanism is coupled to the grasping mechanism for moving the grasping mechanism from a refuse container grasping position to a dumping position. The lifting and dumping mechanism includes elongated linking arms and a driving hydraulic cylinder coupled in a four point movement for simultaneously lifting and rotating the grasping mechanism from the refuse container grasping position into the dumping position.

19 Claims, 8 Drawing Sheets

SIMPLIFIED REFUSE COLLECTION APPARATUS

FIELD OF THE INVENTION

This invention relates to simplified refuse collection apparatus and more specifically to a refuse collection apparatus with fewer components and simpler maintenance.

BACKGROUND OF THE INVENTION

In the refuse collection industry, collection trucks are used to travel door-to-door and to empty one or more refuse containers at each site, resulting in an enormous number of operations every day. In general, collection trucks are large and very complicated, using multiple hydraulic cylinders to reach out and grasp refuse containers, lift them into a vertically elevated position over a refuse receiving opening in the truck, and then rotate the refuse container to empty the contents into the truck. For the best return on the cost of the collection truck, the trucks must be in operation every day and as long as possible. This constant heavy use under very poor conditions, i.e. spilled or blown refuse often collects around the working components of the collection apparatus, results in heavy wear, frequent breakage, and nearly continuous maintenance. Also, because the collection trucks often include many hydraulic cylinders and many moving parts, they are complicated to maintain, i.e. clean and repair.

It would be highly advantageous, therefore, to remedy the foregoing and other deficiencies inherent in the prior art.

Accordingly, it is an object of the present invention to provide new and improved refuse collection apparatus.

Another object of the invention is to provide new and improved refuse collection apparatus that is easier and less expensive to manufacture and maintain.

A further object of the present invention is to provide new and improved refuse collection apparatus that includes fewer components.

SUMMARY OF THE INVENTION

Briefly, to achieve the desired objects of the instant invention in accordance with a preferred embodiment thereof, provided is refuse collection apparatus including a collection container grasping mechanism and a lifting and dumping mechanism. The grasping mechanism includes a pair of grasping arms mounted for movement between an at-rest position and a grasping position, springs attached to the grasping arms so as to bias the grasping arms into the at-rest position, and a first hydraulic cylinder attached to an activating element for moving the grasping arms from the at-rest position into the grasping position. The lifting and dumping mechanism is coupled to the grasping mechanism for moving the grasping mechanism from a refuse container grasping position to a dumping position. The lifting and dumping mechanism includes elongated linking arms and a driving hydraulic cylinder coupled in a four point movement for simultaneously lifting and rotating the grasping mechanism from the refuse container grasping position into the dumping position.

In a specific embodiment a track is provided including upper and lower elongated plates affixed to upper and lower sides of a central member, respectively. The transverse width of the upper and lower elongated plates is greater than a transverse width of the central member to form horizontally extending, vertical channels on opposite sides of the central member. The lifting and dumping mechanism includes a carriage with a pair of vertically oriented, spaced apart side plates and two sets of wheels rotatably mounted between the spaced apart side plates in opposed relationship. The carriage is mounted on the track for horizontal movements with the two sets of wheels positioned in the vertical channels to limit vertical movement.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE DRAWINGS

Figure 1:
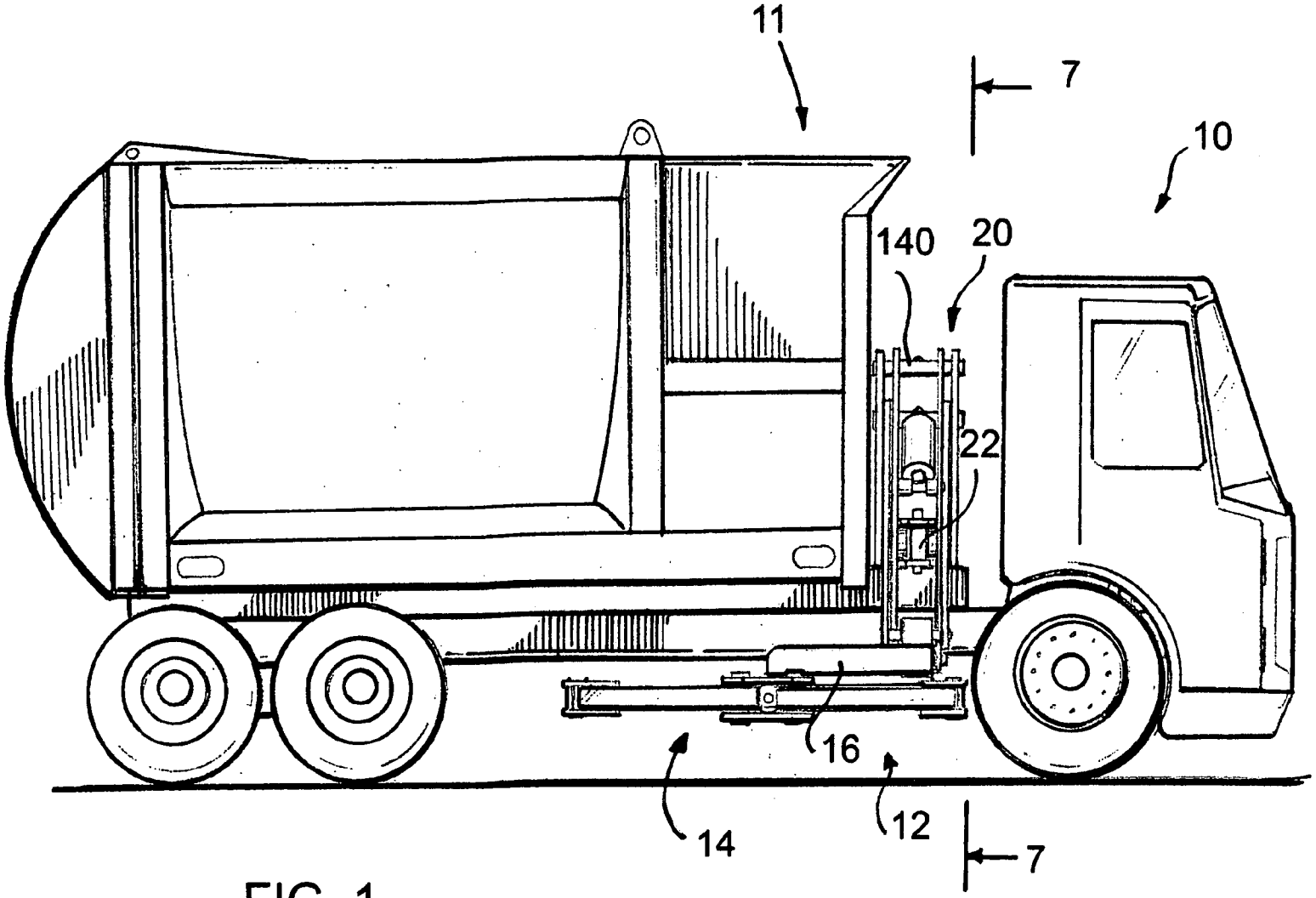
FIG. 1 is a side view of a refuse collection truck with the improved refuse collection apparatus mounted thereon in accordance with the present invention.

Turning now to the drawings, attention, is first directed to FIG. 1, which illustrates a refuse collection truck, generally designated 10, with refuse collection apparatus 12 mounted thereon in accordance with the present invention. Refuse collection apparatus 12 includes collection container grasping mechanism, generally designated 14, attached by a mounting arm 16 to a lifting and dumping mechanism 20, which is mounted for horizontal movements on a track 22. It should be noted as the description proceeds that the entire refuse collection apparatus 12 is operated, in the preferred embodiment, with three hydraulic cylinders to perform all of the movements required in the collection process.

Figure 2:
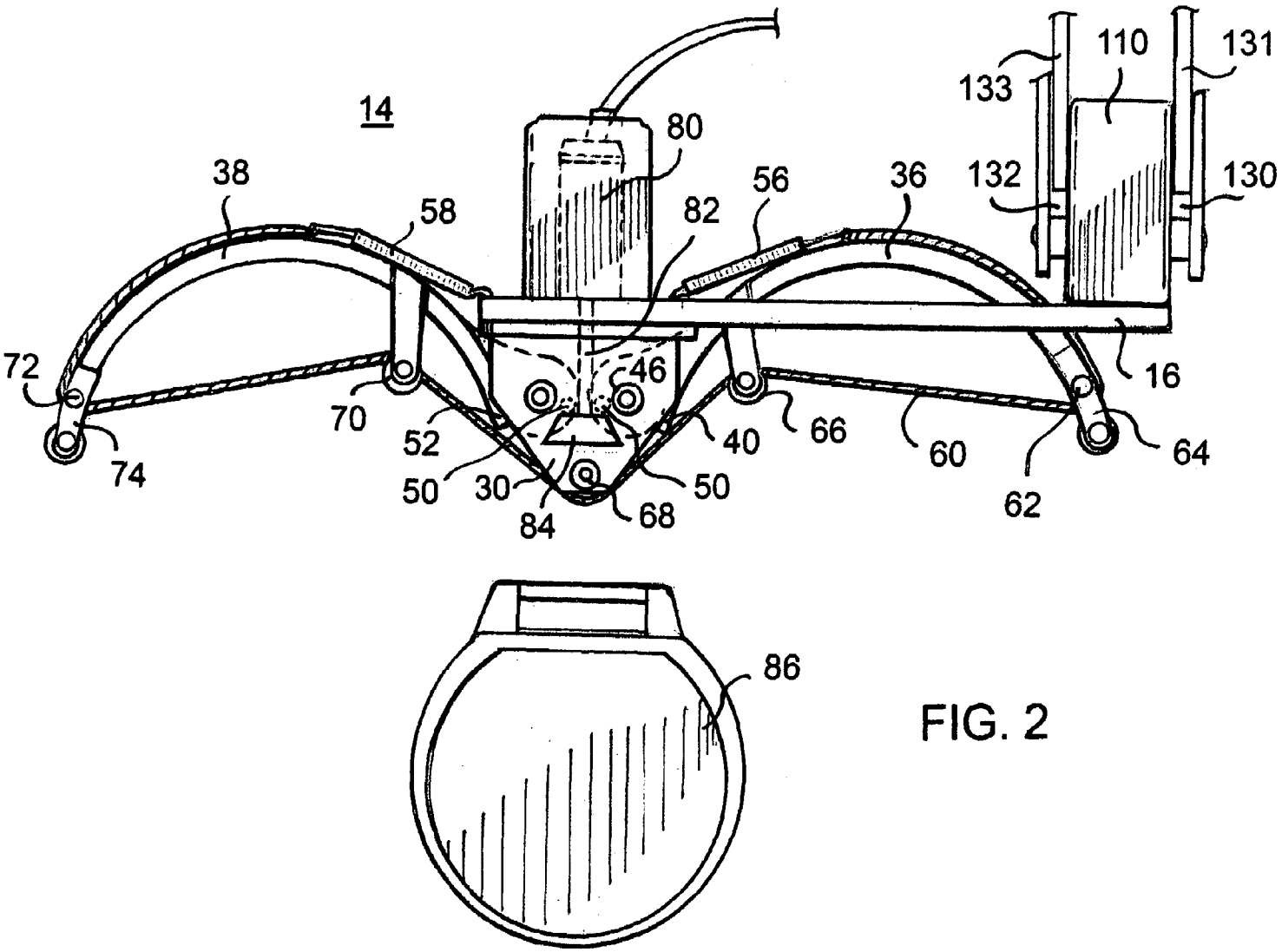
FIG. 2 is an enlarged top plan view of a collection container grasping portion of the collection apparatus of FIG. 1, hidden components illustrated in broken lines for better understanding.

Turning now to FIG. 2, an enlarged top plan view of collection container grasping mechanism 14 is illustrated. Grasping mechanism 14 includes a mounting base 30, with a generally U-shaped cross section, fixedly attached to an extended end of mounting arm 16 to provide a lower mounting surface 32 and an upper mounting surface 34 (see FIG. 5). A first generally arcuately shaped grasping arm 36 and a second generally arcuately shaped grasping arm 38 are mounted by base 30 for opposed pivotal movements between an at-rest or stored position (as shown in FIGS. 2 and 3) and a refuse container grasping position (as shown in FIG. 4).

Figure 5:
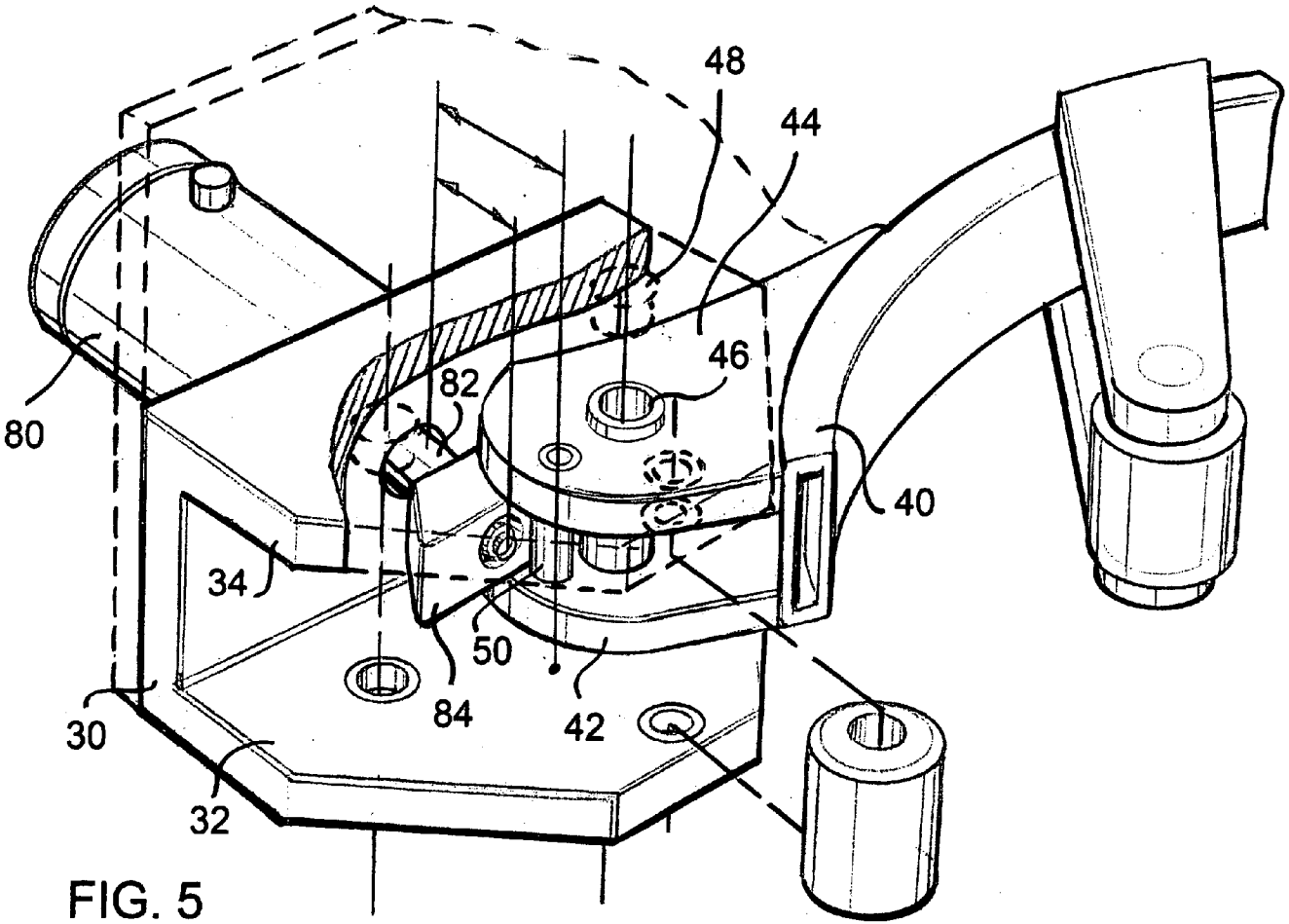
FIG. 5 is an enlarged top perspective, exploded view of the operating mechanism for the grasping portion of FIG. 2, portions thereof removed and shown in section.

Referring additionally to FIG. 5, it can be seen that grasping arm 36 includes an end 40 with a lower mounting plate 42 and a spaced apart upper mounting plate 44 affixed thereto and positioned in a parallel relationship between lower mounting surface 32 and upper mounting surface 34 of mounting base 30. End 40 is pivotally mounted by means of a cylindrical bearing block 46 extending through lower mounting plate 42 and upper mounting plate 44 with a pivot pin 48 extending through lower mounting surface 32, bearing block 46, and into upper mounting surface 34. An actuating pin 50 is also mounted in a vertical orientation between lower mounting plate 42 and upper mounting plate 44. An end 52 of grasping arm 38 is a mirror image of end 40 of grasping arm 36 and will not be described in detail except to mention that it includes an actuating pin also designated 50.

A tension spring 56 has one end attached to base 30 and the other end extending partially along arm 36. Similarly, a tension spring 58 has one end attached to base 30 and the other end extending partially along arm 38. A flexible rope 60, formed of any convenient material (e.g. wire strands, etc.), is attached at one end to the extended end of spring 56 and at the other end to the extended end of spring 58. Rope 60 extends over a pulley 62 adjacent an outer end 64 of arm 36, under a pulley 66 mounted by an extension on arm 36 adjacent base 30, over a pulley 68 mounted between lower mounting surface 32 and upper mounting surface 34 of base 30 at an extended tip thereof, under a pulley 70 mounted by an extension on arm 38 adjacent base 30, and over a pulley 72 adjacent an outer end 74 of arm 38. Springs 56 and 58, along with rope 60, provide a bias on arms 36 and 38 tending to move them outwardly into the at-rest or stored position shown in FIG. 2. Because there is no force on arms 36 and 38 other than friction in the mounting structure, springs 56 and 58 can easily bias them into the at-rest or stored position with a minimum of force.

Figure 3:
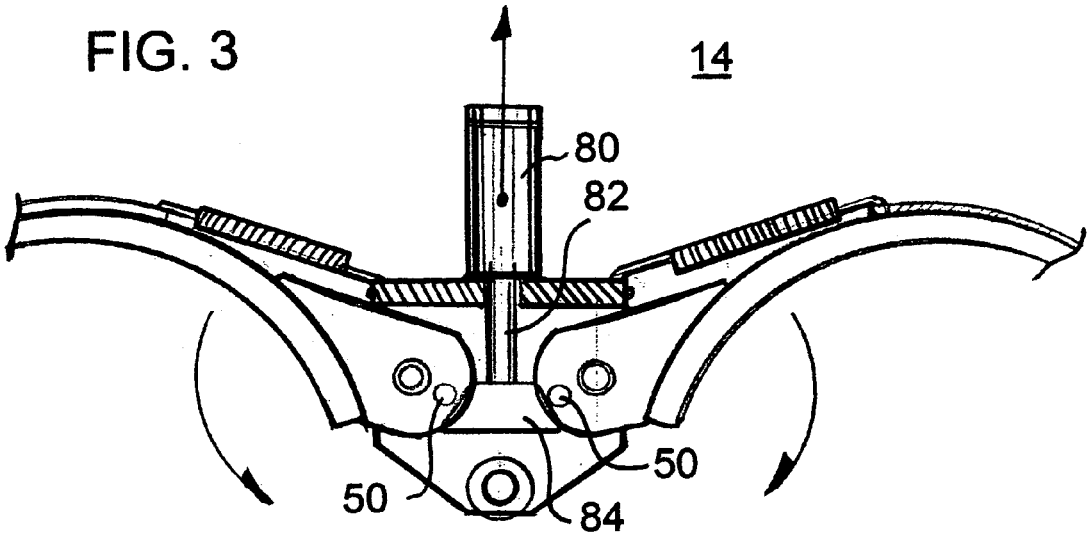
FIG. 3 is a partial top plan view of the grasping portion of FIG. 2, in an opened orientation, portions of the housing removed.
Figure 4:
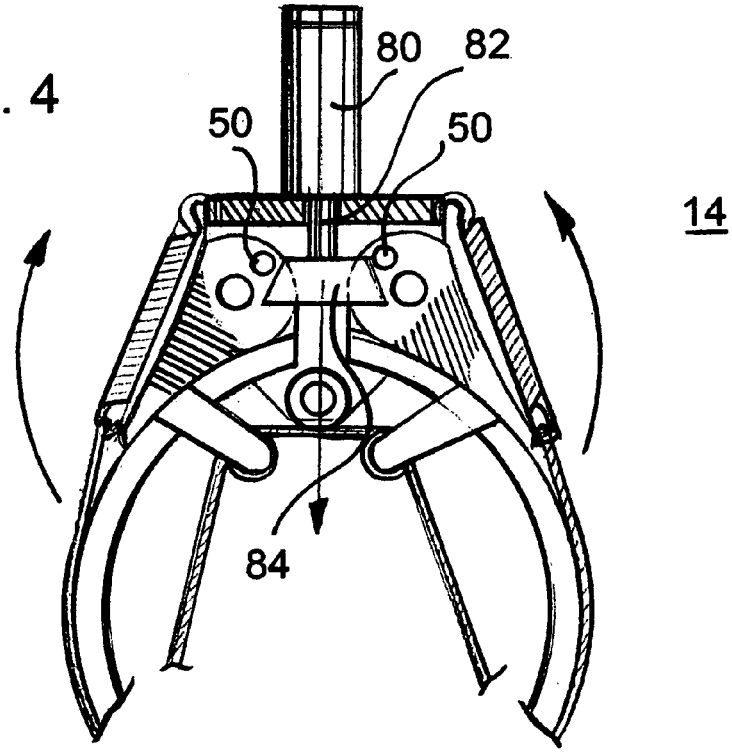
FIG. 4 is a partial top plan view similar to FIG. 3 of the grasping portion, in a closed orientation, portions of the housing removed.

A hydraulic cylinder 80 is mounted on the rear surface of mounting base 30 with a piston arm 82 extending through the rear wall of mounting base 30 and between actuating pins 50 of actuating arm ends 40 and 52 (see FIGS. 3 and 4). An actuating element 84 is attached to the end of piston arm 82 and is designed to engage actuating pins 50 on either the rear or end edges. Hydraulic cylinder 80 is the type that withdraws piston arm 82 into the cylinder under power. Thus, when pressurized hydraulic fluid is applied to hydraulic cylinder 80, piston arm 82 is drawn into the cylinder and actuating element 84 draws actuating pins 50 toward the rear surface of mounting base 30. This movement of actuating pins 50 causes arms 36 and 38 to pivot about pivot pins 48 in counterclockwise and clockwise directions, respectively, producing the closing or grasping action illustrated in FIG. 4. Arms 36 and 38 are designed to grasp a refuse container 86 firmly so that it can be lifted and emptied. Once the emptying is completed and container 86 is returned to the ground, hydraulic pressure on hydraulic cylinder 80 is reversed and piston arm 82 is again fully extended. With the pressure on actuating pins 50 released, the bias produced by springs 56 and 58 quickly returns arms 36 and 38 to the at-rest or stored position.

Figure 6:
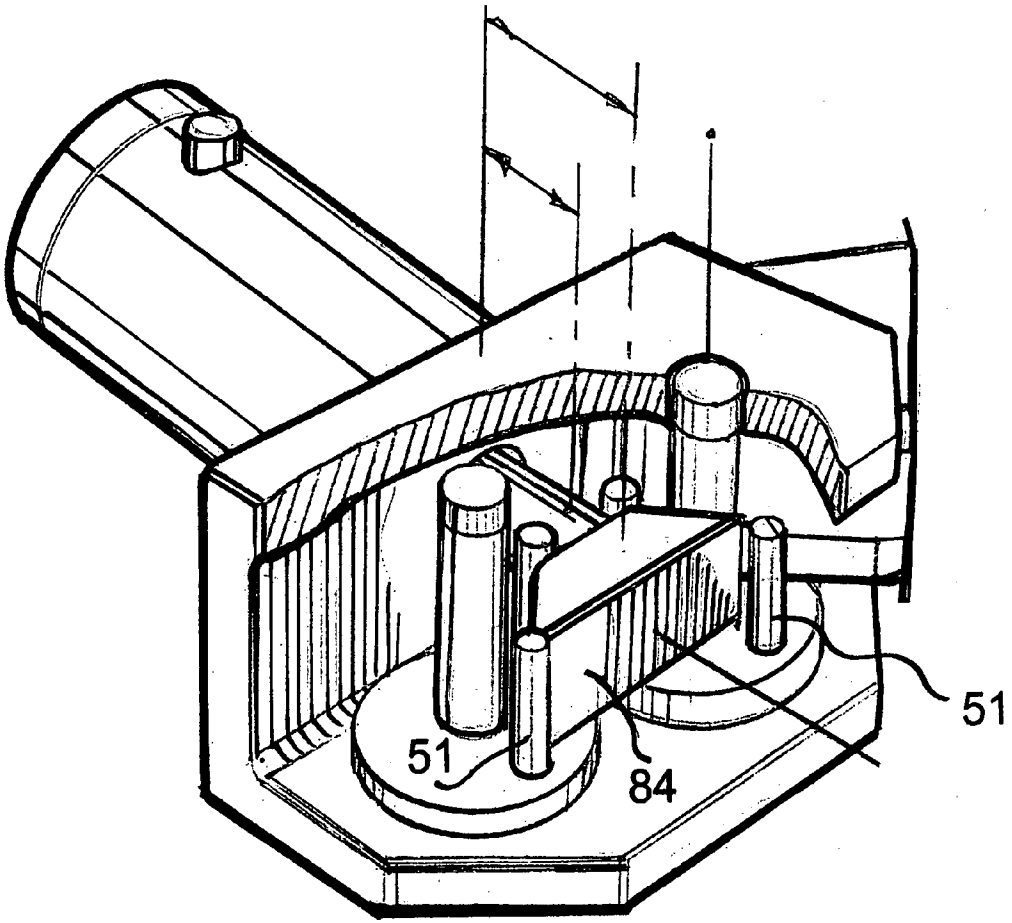
FIG. 6 is an enlarged top perspective, exploded view of a slightly modified operating mechanism (from the operating mechanism of FIG. 5) for the grasping portion of FIG. 2, portions thereof removed and shown in section.

Turning now to FIG. 6, a slight modification of the operating mechanism of FIG. 5 is illustrated. In this modification, components similar to components in the embodiment of FIG. 5 are designated with similar numbers and operate in a similar fashion. The major difference in this embodiment is the addition of a second set of pins 51, one in each actuating arm end 40 and 52, parallel to and spaced from actuating pins 50. Pins 51 are included to provide positive movement of arms 36 and 38 into the at-rest or stored position, even if springs 56 and 58 do not provide sufficient bias. Insufficient bias by springs 56 and 58 could occur if an obstruction is present, if the springs fail, or in some other situation. In such instances, reversal of hydraulic cylinder 80 extends piston arm 82 out of the cylinder under power to the fully extended position and actuating element 84 moves pins 51 causing arms 36 and 38 to pivot about pivot pins 48 in clockwise and counterclockwise directions, respectively, producing an opening action that enhances and/or replaces the bias by springs 56 and 58.

Figure 7:
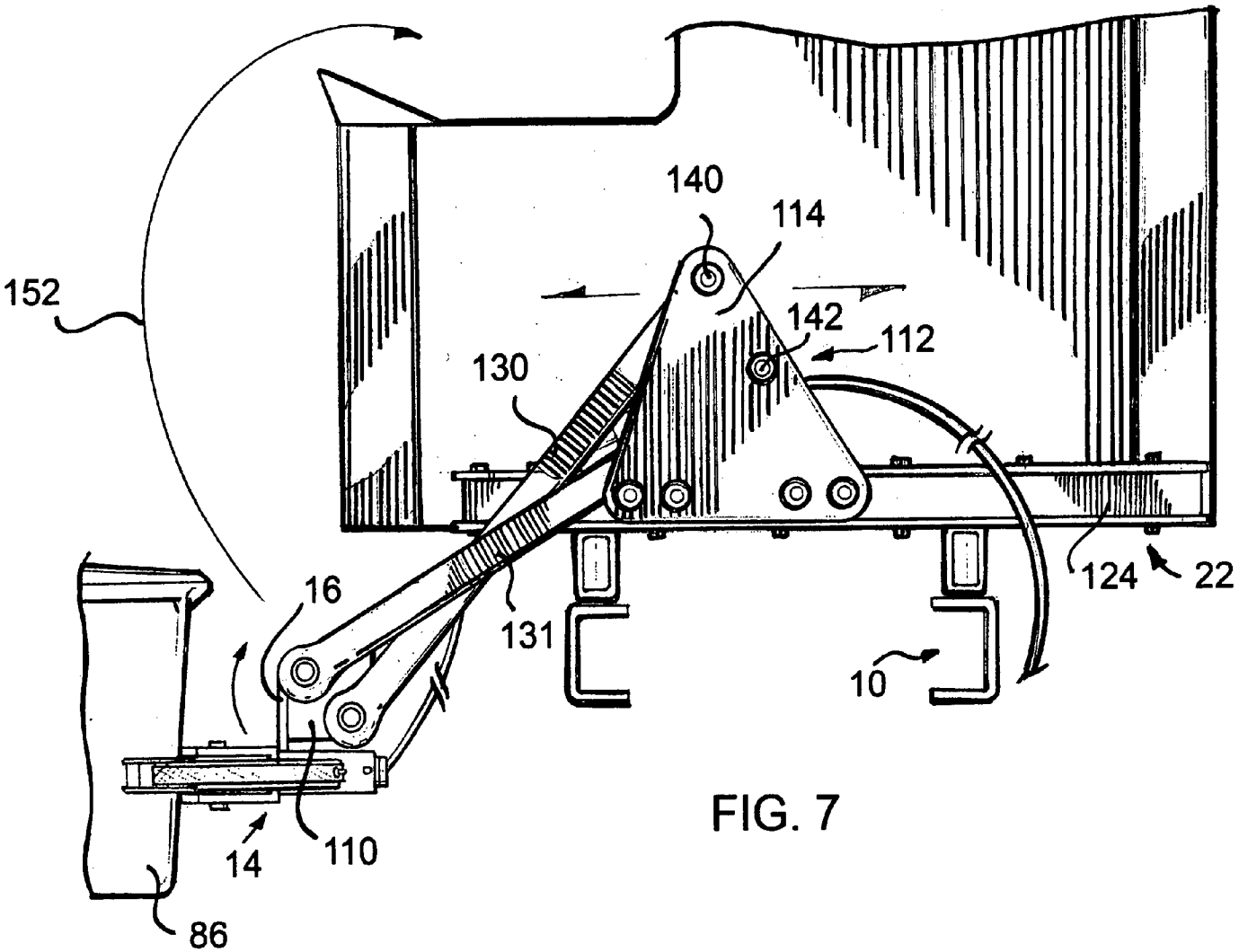
FIG. 7 is a side view of the collection apparatus as seen from the line 7-7 of FIG. 1.

As can be seen best in FIG. 2, collection container grasping mechanism 14 is attached to one end of mounting arm 20 and lifting and dumping mechanism 20 is attached to the other end by means of a mounting block 110. Referring additionally to FIG. 7, a side view of lifting and dumping mechanism 20 is illustrated. Lifting and dumping mechanism 20 is provided to move grasping mechanism 14 from a refuse container grasping position (generally adjacent and horizontal to the ground) to an elevated dumping position generally above a refuse receiving opening 11 in truck 10. Mechanism 20 includes a horizontally moveable carriage, generally designated 112, that includes a spaced apart pair of generally triangularly shaped side plates 114 and 116 (see FIG. 8). Each side plate 114 and 116 has four wheels or rollers 120 and 122, respectively, mounted on the inside surface along the lower edge so as to be positioned within vertical channels 124 and 126 on opposite sides of track 22. The combination of wheels 120 and 122 with channels 124 and 126 allows horizontal movement of carriage 112 while preventing tipping or vertical movement.

Carriage 112 is coupled to mounting block 110 by four elongated linking arms 130, 131, 132, and 133, each of which is pivotally attached to carriage 112 at one end and to mounting block 110 at the opposite end. Further, linking arms 130 and 131 form a cooperating pair that are pivotally coupled between triangular side plate 114 and one side of mounting block 110 and linking arms 132 and 133 form a cooperating pair that are pivotally coupled between triangular side plate 116 and the opposite side of mounting block 110. One end of each of linking arms 130 and 132 is pivotally connected adjacent opposite ends of a pivot pin or axle 140 that extends between the upper points of triangular side plates 114 and 116. The opposite ends of linking arms 130 and 132 are pivotally attached to the lower front corner of mounting block 110, on opposite sides. One end of each of linking arms 131 and 133 is pivotally connected adjacent opposite ends of a pivot pin or axle 142 that extends between the triangular side plates 114 and 116 approximately midway between the upper point and the rear lower point. The opposite ends of linking arms 131 and 133 are pivotally attached to the upper rear corner of mounting block 110, on opposite sides. Here it should be understood that linking arms 130, 131, 132, and 133 can be pivotally attached in any of a variety of ways and pivot pins 140 and 142 simply illustrate one convenient structure.

A hydraulic cylinder 150 is pivotally coupled at one end to pivot pin 142 and at the opposite end to a mid-point of both linking arms 130 and 132. Thus, linking arms 130 and 132 are driven links while linking arms 131 and 133 are following links in four point lifting and dumping mechanism 20. When hydraulic pressure is applied to hydraulic cylinder 150, the extended ends of linking arms 130 and 132 are moved in an arc, represented by arcuate arrow 152 in FIG. 6, from the lowered position (shown in FIG. 7) to an extreme or dumping position above refuse receiving opening 11. However, the extended ends of linking arms 131 and 133 rotate around a different axis, or in a different arc, so that as mounting block 110 is rotated upwardly along arc 152 by linking arms 130 and 132, linking arms 131 and 133 rotate mounting block 110 (and collection container grasping mechanism 14) in a clockwise direction to empty refuse container 86 held by grasping mechanism 14 into truck 10. Thus, the entire lifting and dumping operation is performed by one hydraulic cylinder.

Figure 8:
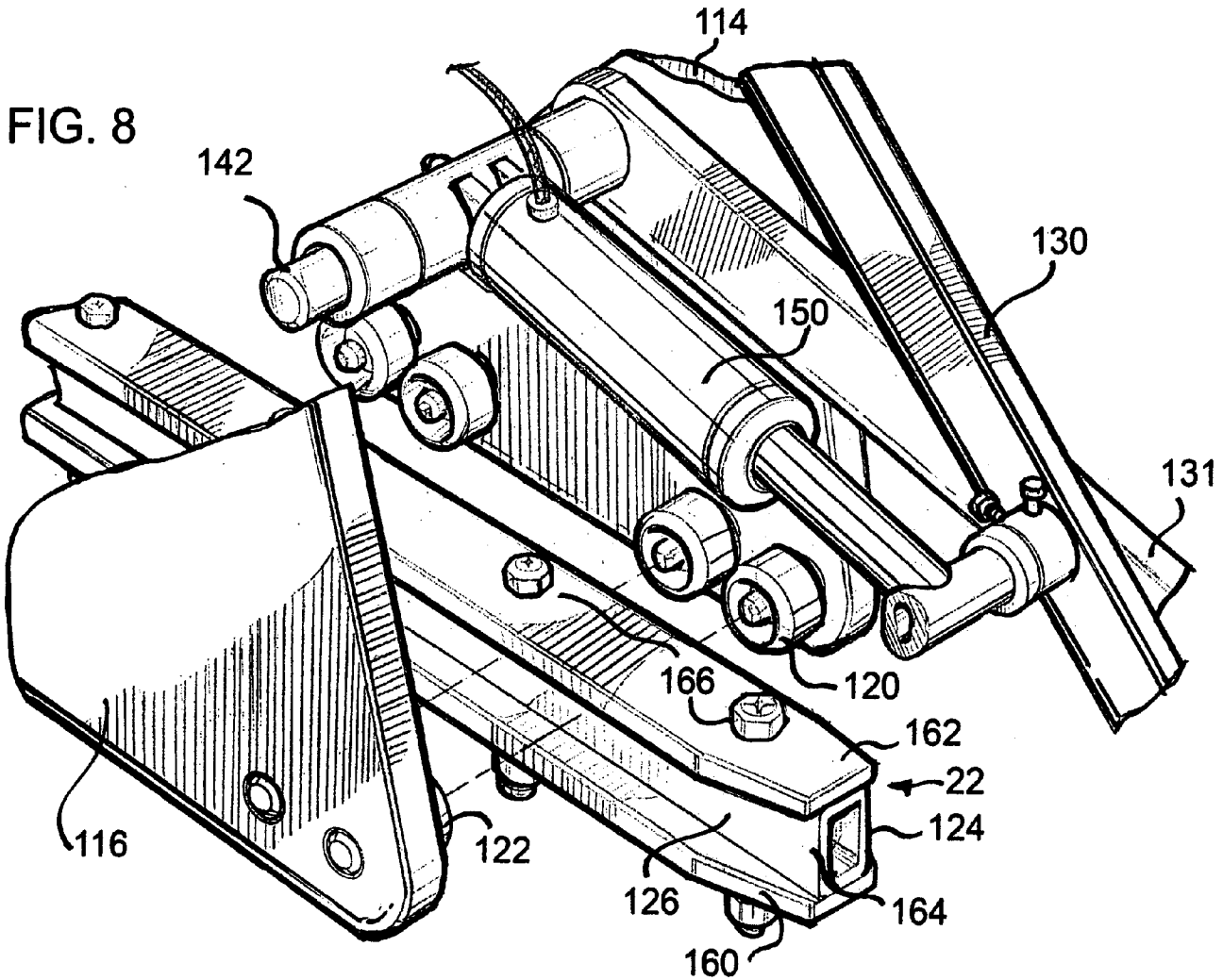
FIG. 8 is an enlarged top perspective view of the lifting and dumping mechanism of the collection apparatus of FIG. 1.
Figure 9:
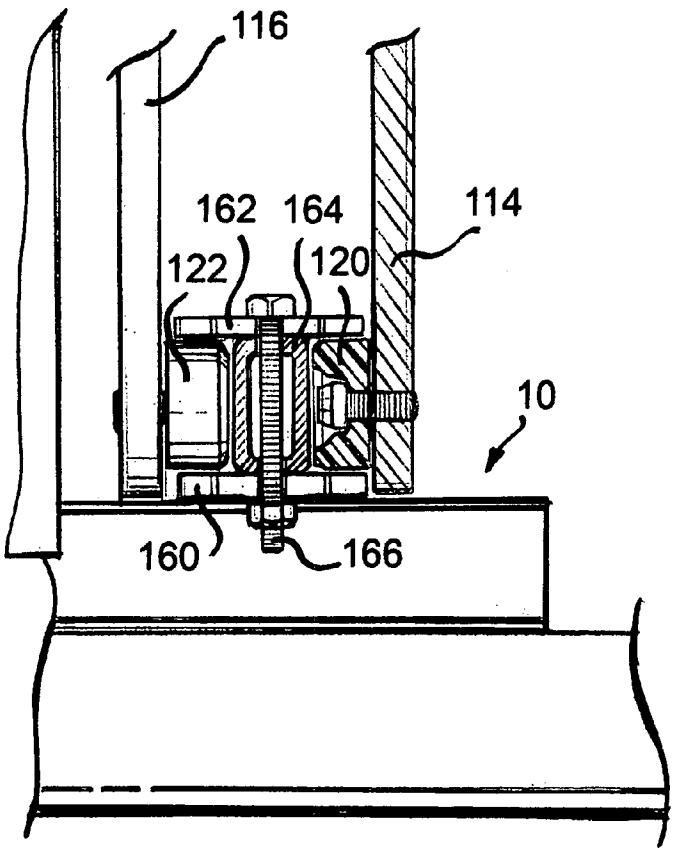
FIG. 9 is a partial front view of the lifting and dumping mechanism of FIG. 8, portions broken away and shown in section.

While truck 10 is moving between collection sites or operations, grasping mechanism 14 is in the at-rest or stored position (as shown in FIGS. 1 and 2). Further, lifting and dumping mechanism 20 is withdrawn horizontally along track 22 so as to not produce a hazard as truck 10 moves along its route. Track 22 is provided to allow the proper horizontal movement for carriage 112, which is generally accomplished by a hydraulic cylinder (not shown). As can be seen in FIG. 8 and with additional reference to FIG. 9, track 22 includes a lower elongated plate 160 and an upper elongated plate 162 separated by a central member, which in this embodiment is a tubular member 164 with a rectangular cross-section. Lower plate 160 and upper plate 162 have a transverse width greater than the transverse width of tubular member 164 so that channels 124 and 126 are formed on opposite sides of track 22. Track 22 is attached to the chassis of truck 10 by means of a plurality of spaced apart bolts 166 that extend through holes in upper plate 162, opposite sides of tubular member 164, lower plate 160 and a portion of the chassis of truck 10.

Figure 10:
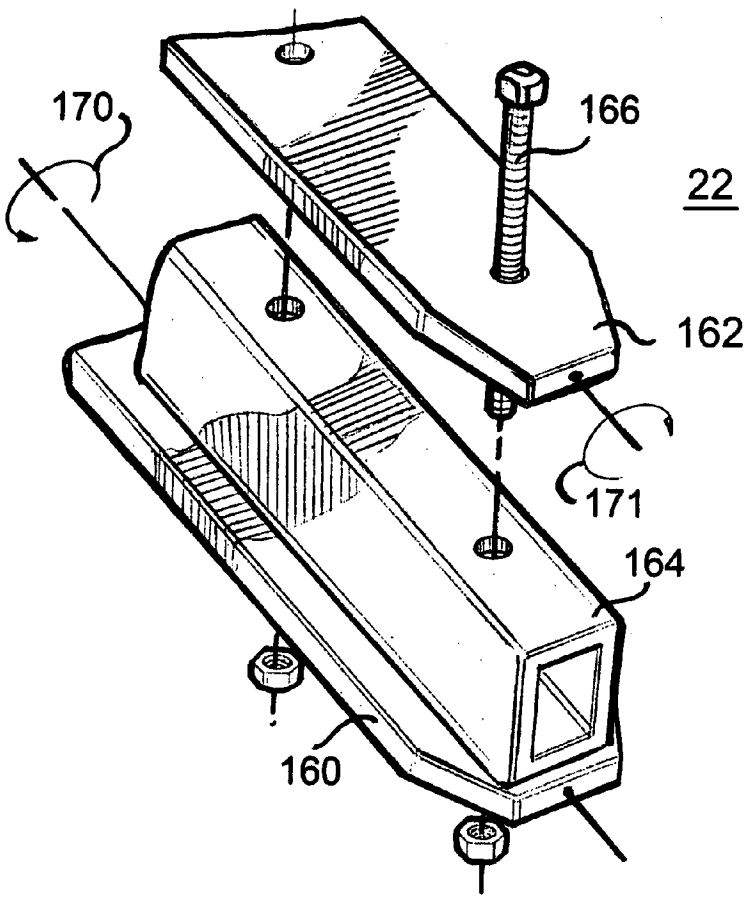
FIG. 10 is an exploded perspective view of a track used in the lifting and dumping mechanism of FIG. 8.

Wheels 120 and 122 of carriage 112 are positioned in channels 124 and 126, respectively, and vertical movement of carriage 112 is restricted by the upper surface of lower plate 160 and the lower surface of upper plate 162. Because grasping mechanism 14 is moved horizontally outward to a refuse container (e.g. container 86) generally in every collection operation, the resulting wear on lower plate 160 and upper plate 162 is substantial. Thus, one of the most frequent maintenance operations is to repair track 22. In this preferred embodiment, lower plate 160 and upper plate 162 are substantially identical so that a single stock of elongated plates is required for maintenance purposes. Further, because of the novel construction of track 22, some additional use of lower plate 160 and upper plate 162 can be achieved by simply removing the worn plate and rotating it 180 degrees about the longitudinal axis (illustrated by arrows 170 and 171 in FIG. 10). This simple rotation of one or both of the elongated plates substantially increases the life of track 22 and reduces the cost.

Thus, refuse collection apparatus is disclosed in which as few as three hydraulic cylinders are used to perform all of the collection operation. Further, both the collection container grasping mechanism and the lifting and dumping mechanism use a minimum of parts and are easy to clean and maintain. Accordingly, new and improved refuse collection apparatus is disclosed that is easier and less expensive to manufacture and maintain and that includes fewer components.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

The invention claimed is:

1. Refuse collection apparatus comprising:

collection container grasping mechanism including a pair of grasping arms mounted for movement between an at-rest position and a grasping position, each grasping arm of the pair of grasping arms is pivotally mounted at one end in a mounting base, the one end of each of the grasping arms having a lower mounting plate, an upper mounting plate spaced apart from the lower mounting plate, and an actuating pin mounted between the lower mounting plate and the upper mounting plate of each grasping arm, a first hydraulic cylinder having a piston arm extending between the pivotally mounted ends of the pair of mounting arms and the actuating pins and terminating in an actuating element having a surface contacting the actuating pin of each grasping arm, the surface of the actuating element contacting the actuating pins of each grasping arm when the first hydraulic cylinder is moved to a withdrawn position in which the actuating element is moved toward the first hydraulic cylinder to pivotally rotate the pair of grasping arms into the grasping position, and disengaging the actuating pins when the first hydraulic cylinder is moved to an extended position; and lifting and dumping mechanism coupled to the grasping mechanism for moving the grasping mechanism from a refuse container grasping position to a dumping position, the lifting and dumping mechanism including a plurality of elongated linking arms and a driving hydraulic cylinder coupled in a four point movement for simultaneously lifting and rotating the grasping mechanism from the refuse container grasping position into the dumping position.

2. Refuse collection apparatus as claimed in claim 1 wherein the pair of grasping arms is biased into the at-rest position by a pair of springs attached to the pair of grasping arms.

3. Refuse collection apparatus as claimed in claim 1 wherein the lifting and dumping mechanism is coupled to the grasping mechanism by a mounting arm, one end of the mounting arm being attached to a mounting base of the grasping mechanism, and the other end of the mounting arm being attached to the lifting and dumping mechanism by a mounting block.

4. Refuse collection apparatus as claimed in claim 1 wherein the lifting and dumping mechanism includes a carriage mounted on a track for horizontal movements.

5. Refuse collection apparatus as claimed in claim 4 wherein the plurality of elongated linking arms includes two pair of linking arms, with one end of each linking arm of each pair of linking arms being pivotally connected to a mounting block attached to the grasping mechanism and the opposite ends of each linking arm of each pair of linking arms being pivotally attached adjacent the carriage, limiting the opposite ends to rotational movement relative the carriage.

6. Refuse collection apparatus as claimed in claim 5 wherein one linking arm in each pair of linking arms is driven by actuation of the driving hydraulic cylinder to move the mounting block and the attached grasping mechanism in a first arc about the carriage and the second linking arm in each pair of linking arms moves in a second arc to produce a rotating dumping action as the mounting block approaches an extreme position in the first arc.

7. Refuse collection apparatus as claimed in claim 4 wherein the carriage of the lifting and dumping mechanism includes a pair of vertically oriented, spaced apart side plates with one end of each of the plurality of elongated linking arms pivotally mounted therebetween.

8. Refuse collection apparatus as claimed in claim 7 wherein the carriage further includes two sets of wheels rotatably mounted between the spaced apart side plates of the carriage in opposed relationship.

9. Refuse collection apparatus as claimed in claim 8 wherein the track defines horizontally extending, vertical channels on opposite sides thereof and the two sets of wheels on the carriage are positioned to move horizontally in the channels and to limit vertical movement.

10. Refuse collection apparatus as claimed in claim 9 wherein the track includes upper and lower elongated plates affixed to upper and lower sides of a central member, respectively, the transverse width of the upper and lower elongated plates being greater than a transverse width of the central member to form the horizontally extending, vertical channels on opposite sides of the central member.

11. Refuse collection apparatus as claimed in claim 10 wherein the upper and lower elongated plates are removably affixed to the central member for replacement.

12. Refuse collection apparatus comprising:

collection container grasping mechanism including a pair of grasping arms mounted for movement between an at-rest position and a grasping position, a first hydraulic cylinder attached to an activating element, the activating element contacting but not attached to each grasping arm of the pair of grasping arms for moving the pair of grasping arms from the at-rest position into the grasping position, each grasping arm of the pair of grasping arms being pivotally mounted at one end in a mounting base, the one end of each of the grasping arms being adjacent each other and in contact with but not attached to the activating element so as to be pivotally rotated by linear movement of the actuating element, and lifting and dumping mechanism including a carriage mounted on a track for horizontal movements, two pairs of linking arms, each pair of linking arms including a straight driven link arm and a straight following link arm, the straight driven link arm of each pair having one end pivotally connected to opposite sides of a mounting block attached to the grasping mechanism and an opposite end pivotally attached adjacent opposite sides of the carriage, limiting the opposite ends to rotational movement relative the carriage, and the straight following link arm of each pair having one end pivotally connected to opposite sides of a mounting block attached to the grasping mechanism and an opposite end pivotally attached adjacent opposite sides of the carriage, limiting the opposite ends to rotational movement relative the carriage, and a driving hydraulic cylinder pivotally coupled at one end to the carriage and at an opposing end to each straight driven link arm intermediate opposing ends thereof, the straight driven link arm in each pair of linking arms being driven by actuation of the driving hydraulic cylinder to move the mounting block and the attached grasping mechanism in a first arc about the carriage and the following linking arm in each pair of linking arms moving in a second arc to produce a rotating dumping action as the mounting block approaches an extreme position in the first arc.

13. Refuse collection apparatus as claimed in claim 12 wherein the carriage further includes two sets of wheels rotatably mounted between spaced apart side plates of the carriage in opposed relationship.

14. Refuse collection apparatus as claimed in claim 13 wherein the track defines horizontally extending, vertical channels on opposite sides thereof and the two sets of wheels on the carriage are positioned to move horizontally in the channels and to limit vertical movement.

15. Refuse collection apparatus as claimed in claim 14 wherein the track includes upper and lower elongated plates affixed to upper and lower sides of a central member, respectively, the transverse width of the upper and lower elongated plates being greater than a transverse width of the central member to form the horizontally extending, vertical channels on opposite sides of the central member.

16. Refuse collection apparatus as claimed in claim 15 wherein the upper and lower elongated plates of the track are removably affixed to the central member for replacement.

17. Refuse collection apparatus as claimed in claim 12 wherein the lifting and dumping mechanism is coupled to the grasping mechanism by a mounting arm, one end of the mounting arm being attached to the mounting base of the grasping mechanism, and the other end of the mounting arm being attached to the lifting and dumping mechanism by the mounting block.

18. Refuse collection apparatus comprising:

collection container grasping mechanism including a pair of grasping arms mounted for movement between an at-rest position and a grasping position, a first hydraulic cylinder attached to an activating element, the activating element contacting but not attached to each grasping arm of the pair of grasping arms for moving the pair of grasping arms from the at-rest position into the grasping position, each grasping arm of the pair of grasping arms being pivotally mounted at one end in a mounting base, the one end of each of the grasping arms being adjacent each other and in contact with but not attached to the activating element so as to be pivotally rotated by linear movement of the actuating element, and springs attached to the pair of grasping arms so as to bias the pair of grasping arms into the at-rest position;

a track including upper and lower elongated plates affixed to upper and lower sides of a central member, respectively, the transverse width of the upper and lower elongated plates being greater than a transverse width of the central member to form horizontally extending, outwardly directed vertical channels on opposite sides of the central member; and lifting and dumping mechanism including a carriage including a pair of vertically oriented, spaced apart side plates and two sets of inwardly directed wheels rotatably mounted between the spaced apart side plates in opposed relationship, the carriage being mounted on the track for horizontal movements with the two sets of wheels positioned in the vertical channels to limit vertical movement, two pairs of straight linking arms, each pair of straight linking arms including a driven link arm and a following link arm, the driven link arm of each pair having one end pivotally connected to opposite sides of a mounting block attached to the grasping mechanism and an opposite end pivotally attached to the carriage adjacent opposite ones of the spaced apart side plates, limiting the opposite ends to rotational movement relative the side plates, and the following link arm of each pair having one end pivotally connected to opposite sides of a mounting block attached to the grasping mechanism and an opposite end pivotally attached to the carriage adjacent opposite ones of the spaced apart side plates, limiting the opposite ends to rotational movement relative the side plates, and a driving hydraulic cylinder pivotally coupled at one end to the carriage and at an opposing end to each driven link arm intermediate opposing ends thereof, the driven link arm in each pair of linking arms being driven by actuation of the driving hydraulic cylinder to move the mounting block and the attached grasping mechanism in a first arc about the carriage and the following linking arm in each pair of linking arms moving in a second arc to produce a rotating dumping action as the mounting block approaches an extreme position in the first arc.

19. Refuse collection apparatus as claimed in claim 18 wherein the lifting and dumping mechanism is coupled to the grasping mechanism by a mounting arm, one end of the mounting arm being attached to the mounting base of the grasping mechanism, and the other end of the mounting arm being attached to the lifting and dumping mechanism by the mounting block.

* * * * *